United States Patent [19]

Gourronc

[11] Patent Number: 4,879,966

[45] Date of Patent: Nov. 14, 1989

[54] UNDERWATER PAINTING MACHINE COMPRISING A PAINT APPLICATION DEVICE WITH PULSATORY MOVEMENT ASSOCIATED WITH A ROTARY SMOOTHING DEVICE

[75] Inventor: Eugene Gourronc, Kerivoret Porspoder, France

[73] Assignee: Jean Simon, Borgo, France

[21] Appl. No.: 880,368

[22] Filed: Jun. 30, 1986

[30] Foreign Application Priority Data

Apr. 22, 1986 [FR] France ..... 86 05766

[51] Int. Cl.[4] ..... B05C 1/00

[52] U.S. Cl. ..... 118/207; 118/111; 15/49 R; 15/50 R; 15/107

[58] Field of Search ..... 118/111, 207; 114/222; 15/49 R, 50 R, 107

[56] References Cited

U.S. PATENT DOCUMENTS 2,806,236 9/1957 Di Stefano ..... 118/111 X
3,303,812 2/1967 Sierra et al. ..... 114/222
4,058,082 11/1977 Winn ..... 118/207 X
4,084,535 4/1978 Rees ..... 114/222

FOREIGN PATENT DOCUMENTS 1567045 5/1969 France .
2342875 2/1980 France .
2389420 10/1981 France .

*Primary Examiner*—Shrive P. Beck
*Attorney, Agent, or Firm*—William A. Drucker

[57] ABSTRACT

An underwater painting machine is provided comprising a brush for applying paint on the surface to be treated, driven with a reciprocal translational movement and cooperating with a rotary smoothing brush with axis parallel to the translational direction, wherein said application brush is formed of a plurality of tufts of bristles each fed with paint substantially at a point situated in the center of the non active end of the bristles, the paint being distributed radially and evenly in each tuft about a central channel and being guided by capillarity along the bristles as far as their active end, without the tufts being immersed in a paint filled chamber and passing through a grid.

9 Claims, 3 Drawing Sheets

FIG. 3
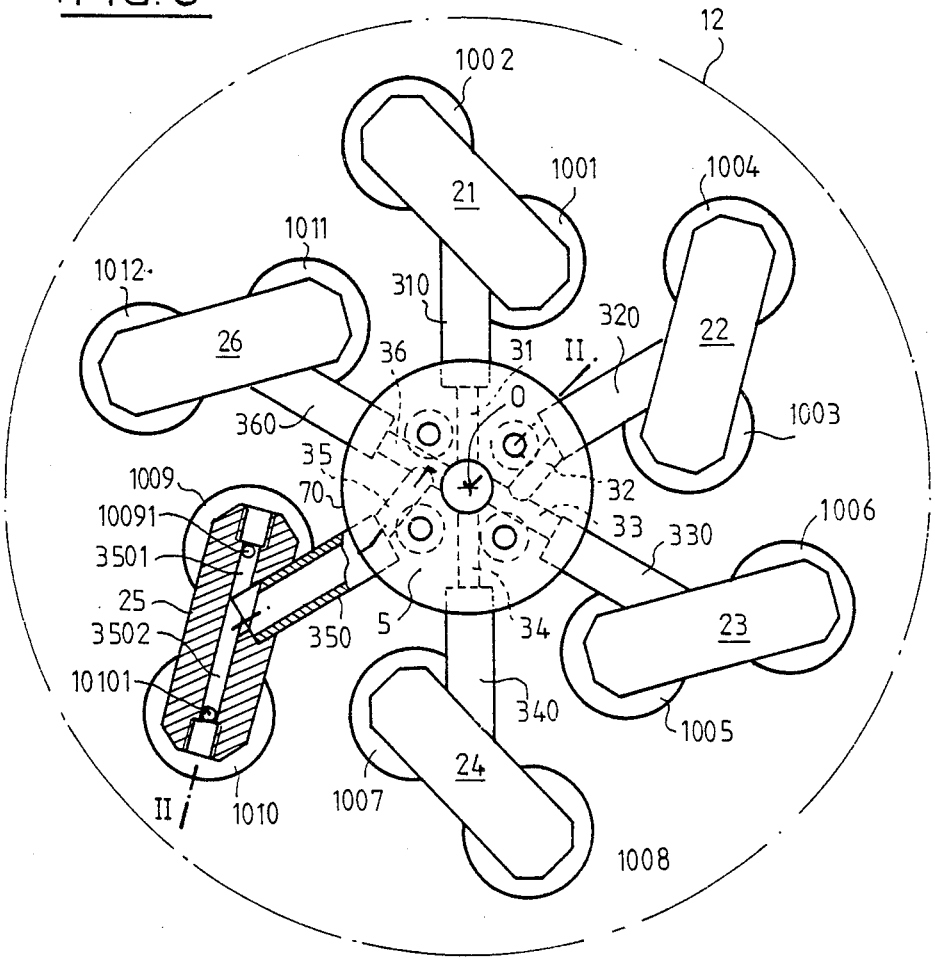
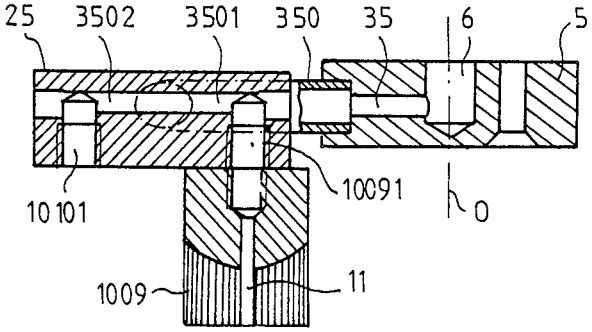
FIG. 4

UNDERWATER PAINTING MACHINE COMPRISING A PAINT APPLICATION DEVICE WITH PULSATORY MOVEMENT ASSOCIATED WITH A ROTARY SMOOTHING DEVICE

BACKGROUND OF THE INVENTION

1. Field of the Invention

The invention relates to an underwater painting machine.

2. Description of the Prior Art

Different apparatus have already been proposed for applying paint to a submerged surface.

FR A 1.567.045 (VAN CAUWENBERGHE et al), applied for on the Aug. 18, 1967, describes an apparatus comprising two brushes which are driven with reciprocal translational movements parallel to the surface to be painted, in reverse directions to each other, these brushes being housed in a casing with feed ducts between the periphery of each brush and smoothing scrapers made from a resilient material.

FR A 2.342.875 (INSTITUTE FOR INDUSTRIAL RESEARCH AND STANDARDS), applied for on the Feb. 22, 1977, describes an apparatus comprising rotary brushes supplied with paint in the center thereof.

FR A 2.389.420 (FLANDIN BLETY), applied for on the 4th May 1977, describes an apparatus combining a rotary movement of the paint application brush with a reciprocal translational movement perpendicular to the surface to be painted, this latter occurring at a frequency which is a submultiple of the rotational frequency and causing the tufts of bristles to pass through feed regulating apertures formed in a grid which closes a casing housing the brush, which casing is constantly filled with paint.

With this latter system, because of the reciprocal translational movement of the bristles perpendicular to the object to be painted and because of the feed regulating apertures, a substantially better application of the paint can be obtained than with the prior systems. This application is however not perfect and the applicant has subsequently, in accordance with FR A 79.199.38 applied for on the Aug. 3, 1979, added a rotary smoothing brush surrounding the application brush and rotating in synchronism therewith without undergoing a translational movement. The apparatus described in this latter patent comprises in actual fact at least four brushes whose movements are synchronized and is relatively complex. It has the drawback, redhibitory in practice, that the casing tends to fill up with a water-paint mixture which prevents any correct deposition of the paint on the surface to be painted and that, being driven in rotation, it does not allow the stencils formed by the tufts of bristles and the feed regulation apertures to correctly deposit the paint they contain at each translational movement.

The invention provides then an underwater painting machine which is of simple and reliable construction and does not have the above mentioned disadvantages, comprising a paint application device with multiple tufts of bristles driven with a reciprocal translational movement perpendicular to the surface to be painted and a rotary smoothing brush rotating at a sufficient speed to ensure by itself the adherence of the machine.

SUMMARY OF THE INVENTION

According to an essential characteristic of the invention, the paint supply is provided, for each of the tufts of bristles, at a point situated substantially in the center of the non active end thereof, the paint being distributed radially and evenly in the tuft about a central feed orifice and being guided by capillarity along the bristles as far as the paint application end thereof, without the tufts of bristles being immersed in a paint filled chamber and passing through a grid.

In a preferred embodiment, the whole of the application device is mounted freely rotating about an axis perpendicular to the surface to be painted.

BRIEF DESCRIPTION OF THE DRAWINGS

Other features, and advantages of the invention will be clear from the following description with reference to the accompanying drawings in which:

FIG. 3 is a schematical top view of a paint application brush according to a preferred variant; and FIG. 4 is a sectional view through the broken line II—II of FIG. 3, showing the diverted feed ducts of a pair of tufts of bristles.

The same reference numbers designate similar elements in the Figures.

DESCRIPTION OF THE PREFERRED EMBODIMENTS

Figure 1:
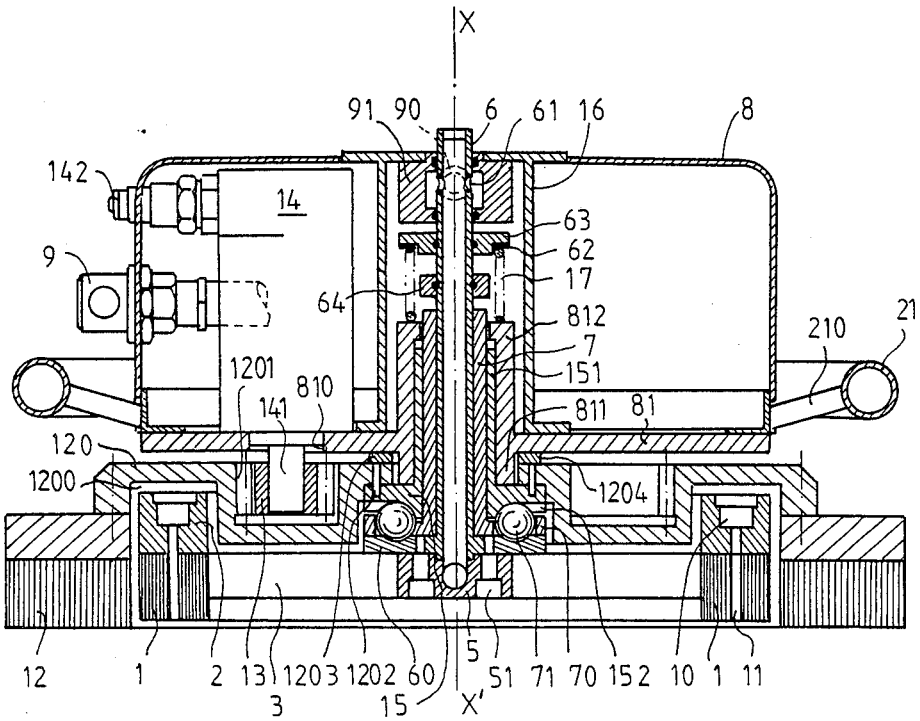
FIG. 1 is a sectional view, through I—I of FIG. 2, of the submerged part of a painting machine in accordance with one embodiment of the invention.

The machine comprises essentially a motor driven surface unit, not shown, a pulse generating mechanism, a device for applying and a device for smoothing the paint.

The application device (FIGS. 1 and 2) is formed of a plurality of tufts of bristles or brushes 1, advantageously cylindrical, having for example a diameter of 30 mm and disposed in a ring in the embodiment described (by way of example the diameter of the ring is 250 mm). The support for these brushes is mounted freely rotating about an axis XX' so as to be able to move reciprocally in translation along this axis. In the embodiment described, it is formed of a ring 2 with spokes 3, 4 and a hub 5 extended by a paint distributing tube 6 centered on the axis XX' and secured to the hub (screws 51).

This tube is mounted freely rotating in a sleeve 7 forming a bearing, having at its base a collar 70 bearing on the flange 60 with which the base of tube 6 is provided. Balls 71 roll at their base on an annular running track of piece 60 and at their top on a cam profile track of piece 15. They are held in position with constant spacing by holes in collar 70, which is itself secured against rotation and free to move in translation along axis XX'.

Figure 2:
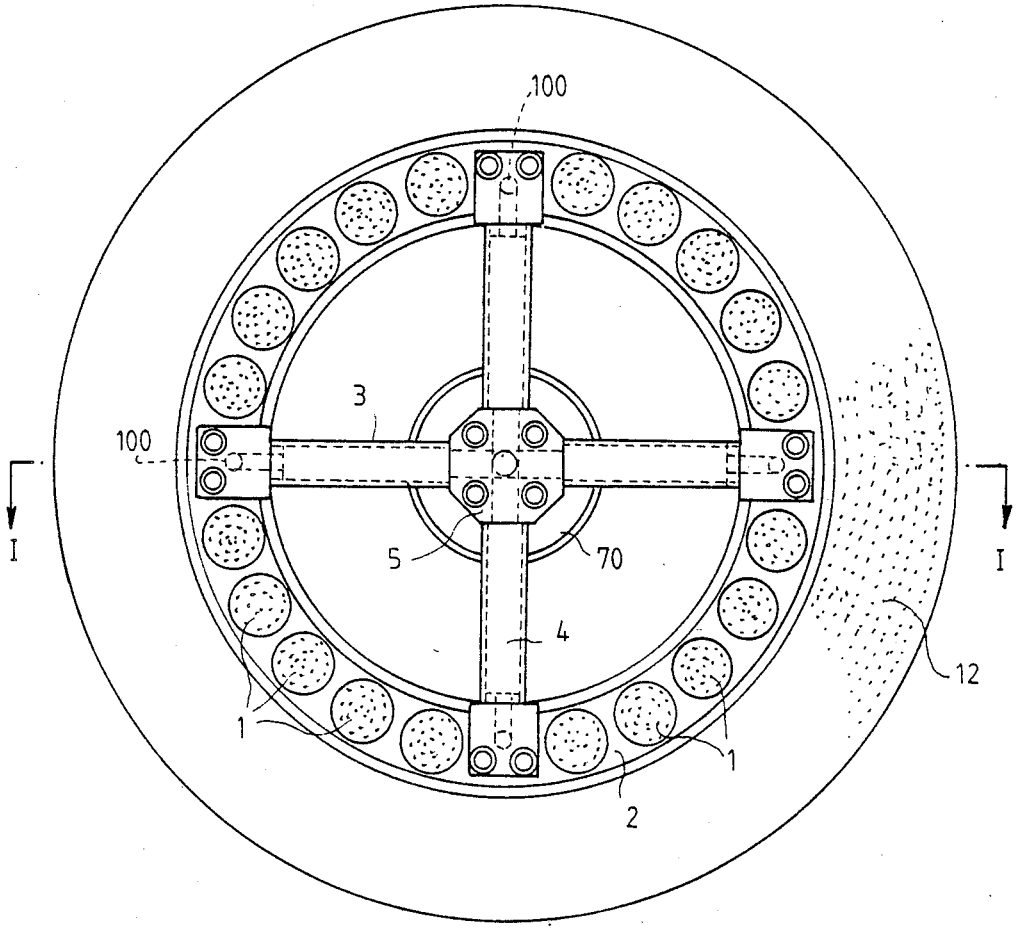
FIG. 2 is a bottom plan view of this machine.

The paint enters tube 6 in the vicinity of its upper closed end, through orifices 61, and at its base arrives through hub 5 into the hollow tubular arms 3–4 and, through channels shown at 100 in FIG. 2, into an annular chamber 10 formed in the ring 2 at the upper part of the brushes, and then moves down through the central channel 11 formed in the tuft of bristles. There is not shown in the Figure the connection, inside casing 8 of the machine, between the coupler 9 which conveys the paint from a reservoir forming part of the motor driven surface unit and the flexible duct which emerges at 90 into a fixed chamber of piece 91 forming a paint collector and in which the orifices 61 are immersed. The feed is provided by means of a hydraulic motor driven pump for circulating the paint, which also forms part of said unit.

The smoothing device is formed by an annular brush 12 having, for example, an outer diameter of 400 mm and a thickness of 55 mm. This brush is fixed to a drive disk 120 with toothed profile.

A first lower annular groove 1200 houses the ring of brushes 1, whereas a second upper annular groove 1201 serves for driving, its surface being toothed for meshing with the pinion 13 mounted on the shaft 141 of the motor 14. In the non limitative embodiment described, the motor 14 is hydraulic and is housed in the housing 8, from which its shaft 141 projects; 142 designates a coupler for the inflow and outflow of the pressurized oil. As a variant, the motor could for example be electric.

Disk 120 drives, through drive pins 1202, the cam 15 already mentioned. This latter forms a sleeve 151 and a lower flange having a profile surface 152 bearing on the balls 71. The bottom of casing 8 has, besides the opening 810 through which the shaft 141 passes, a central part in the form of a sleeve completely open towards the bottom (portion 811) and having at the top (portion 812) an opening for passing the collar 7 therethrough, which is mounted for sliding without rotating in said opening.

The integral assembly formed by brush 12, its drive disk 120 and cam 15 rotates about the axis XX' at a speed determined by motor 14 and advantageously between 60 and 80 rpm. The profile of the cam surface is such that, at each revolution, each of the successive balls is subjected to a reciprocal translational movement parallel to the axis XX', thus communicating an identical translational movement to the distributing tube 6 and to the ring 2. A spring 17 is mounted between the upper fixed surface of the sleeve portion 812 and a friction spacer 62 fixed to their upper end and which surrounds shaft 6. A rotary pin 63 integral with shaft 6 bears slidably on the spacer 62 and the spring thus returns shaft 6 and the pieces which are integral therewith upwardly of the Figure, accompanying the movement of the balls rolling on cam 15. Collar 7 is itself free in translation because it is fixed between cam 15 and flange 60. A safety stop 64, integral with shaft 6, prevents piece 62 and shaft 6 from escaping downwards should piece 63 accidently break. An internal cylindrical housing 16 forms a removable structural element which supports piece 91 and houses pieces 62-63-64 and the upper portion of sleeve 812. The position of drive disk 120 with respect to the fixed bottom 81 of the housing is fixed by means of friction shims 1203-1204.

A circular fly wheel 21 completely surrounding the casing and fixed to the base thereof via arms 210 allows the machine to be handled in all directions. In the case of a mechanical control, fixing is provided by piece 16.

By way of preferred example, four balls are provided evenly spaced apart about axis XX', and the rotational speed of the drive disk is 60rpm, so that the pusling frequency of the paint application device is 4 Hz. The double amplitude of the pulsating translation is 5 mm. The brushes may be slanted from 1° to 5° with respect to the axis XX', their active end being further away from the axis than their opposite end. This arrangement, which is not obligatory, is advantageous for it generates a slight rotational component which means that the assembly tends, as a function of the friction, to rotate random fashion about the axis XX', which improves the distribution of the paint while reducing the edge effects and increases the lifespan of the device by evening out the wear of the bristles. Of course, casing 8 is arranged, in a way not shown, so as to provide a slight floatability.

The operation of the paint application device rests essentially on the fact that bristles are fed with paint at a plurality of points situated at the non active end of tufts of bristles, in each of which the paint is distributed radially evenly about the central feed orifice and is guided by capillarity along the bristles as far as the application end, these tufts of bristles not being immersed in a paint filled chamber. Provided of course that the paint injection pressure is adjusted (supplied by the above mentioned circulation pump) to a low value which will take into account its degree of viscosity but which will be just sufficient for compensating the pressure loss in the ducts of chamber 10, with, in practice, a slight over pressure and a very low flow rate adjustable as a function of the speed of movement of the machine and the thickness of paint desired, there will be not paint running from the brushes or tufts or bristles, and therefore no risk of pollution of the water in which the machine is operating, which is obviously very important; it may be considered that the method of feeding the bristles with paint thus provides a sort of self regulation, which takes place all the better because the assembly of bristles is not subjected to a forced rotational drive. It is the surface to be painted which in a way sucks up exactly the amount of paint which must irrigate it. This suction is largely facilitated by the pulsating movement of hte brushes; the pressure periodically exerted on the paint film causes an effect of force feed of the surface which absorbs, on each application surface, more paint than required, this paint then being spread over the rest of the surface to be painted by the smoothing brushes. The pulsating movement further results in driving the water between the surface to be treated and the tufts of bristles. It will be noted that with an amplitude of the pulsating movement of the order of size indicated above, there is in reality no disengagement of the paintbrush or breakage of the film. Appreciable viscosity variations do not disturb the operation of the machine;

It will be noted that, because of the dimensions of the casing and of the fly wheel, the smoothing brush is visible for the diver, which facilitates the judgement of his work. It will also be noted that, if its rotational speed appreciably exceeded 60 rpm, it would tend to tear off the paint. On the other hand, an appreciably smaller speed of rotation would not allow the machine to adhere to the surface to be treated. This adherence in the machine described is obtained solely because the smoothing brush encloses on the surface to be treated a circular space in which the water is rotated, which provides the slight depression required for adherence.

In FIG. 3, the paint application brush has been shown schematically and the annular smoothing brush is simply shown symbolically by a broken line circle 12 which represents its internal wall. As in the embodiment of FIGS. 1 and 2, the annular smoothing brush is rotated at a speed of 60 rpm for example, but is fixed in translation perpendicular to the plane of the two brushes. The application brush is formed by a plurality of tufts of bristles each fed at a point substantially situated in the center of the non active end of the bristles, the paint being distributed radially about a central channel (11, FIG. 4) while being guided by capillarity along the bristles as far as their active end. It is mounted freely rotating about an axis which is projected at 0 in FIG. 3 and is driven, by means not shown and which may be identical to those described above, with a reciprocal translational movement parallel to this axis, at the frequency of 4 Hz for example. Its stroke is for example of the order of 2 mm.

Feeding of the central channels of the tufts takes place through a hollow paint supply shaft 6 communicating at its base with four radial ducts 31-33 (forming therebetween an angle of 120°), 34 (forming with 33 an angle of 60°), and 36 (forming with 34 an angle of 120°) and with two ducts 32 (tapped on 33) and 35 (tapped on 36). Ducts 31 to 36 are connected respectively to six radial ducts 310-320 . . . 360 oriented at 60° with respect to each other. Each of the ducts 310 to 360 ends at two branch ducts, such as 3501 and 3502, aligned with each other on each side of the branch point and slanted by an angle which, in the embodiment described, is equal to 45°, with respect to the corresponding radial ducts such as 350.

In FIG. 4 it can be seen that these branch ducts each communicate with the channel 11 of a tuft of bristles via a connection channel such as 10101 and 10091. A single tuft of bristles 1009 has been shown in FIG. 4, but it is clear that piece 25 inside which the branch ducts 3501-3502 and the connection channels 10091 and 10101 are defined provide the feed for a pair of tufts of bristles 1009 and 1010 (FIG. 3).

In FIG. 3 a hub 5 has been shown to which the hollow shaft 6 is fixed and a collar 70 which forms part of a sleeve, not shown, in which shaft 6 is mounted freely rotating.

It can be seen in FIG. 4 that the radial duct 35 is defined in hub 5, but the connection pieces between the support of the tuft of bristles 1009 and hub 5 has not been shown.

Referring again to FIG. 3, it can be seen that duct 310 feeds a pair of tufts 1001-1002, duct 320 feeds two tufts 1003-1004 etc . . . The six tufts 1001-1003-1005-1007-1009-1011 and the six tufts 1002-1004-1006-1008-1010 and 1012 form two concentric rings.

The six tufts of each ring are uniformly spaced apart with an angular pitch of 60°, whereas the tufts of the ring are offset angularly by 30° with respect to those of the other.

Comparing now the operation of the brush in the varient shown in FIGS. 3 and 4 with that of the brush shown in FIGS. 1 and 2, we will now attempt to explain the fact that the first one forms, at first sight surprisingly, a much more uniform paint distribution than the second over the whole surface of the painted band, with, however, for the first one, a layer of paint slightly thinner at the edges of the band: it will be noted that, to overcome this slight drawback, it is sufficient in the next pass to cause the second band to slightly overlap the first one.

With the brush shown in FIGS. 1 and 2, it is obvious that, with the dimensions given and the speed of movement of the brush of the order of 40 cm per second, the spots of paint produced by each tuft during successive translational movements of the brush will be 10 cm apart. Since the distance between the two tufts which form spots on each of the strips 3 cm in width mentioned above is 22 cm for the diametrical strip, this strip will finally be covered only by pairs each formed of two slightly overlapping spots, which pairs are separated from each other by distances of 10 cm. On the other hand, the paint coverage will be better for strips closer to the edges of the band.

In some cases, the smoothing brush will not succeed in completely smoothing the paint distribution thus obtained.

The free rotation of the brush about its axis takes place in more or less random fashion, in one direction or in the other and with a speed which experience shows is between 0 and 20 rpm, depending on the speed of movement of the diver and on the manner in which he applies the brush to the surface to be treated (in general he applies one side more than the other).

It will be noted that, for the maximum rotational speed noted, the angular movement of the tufts during a period of translation of the brush is 30°, so that the second spot produced by a given tuft is clearly offset laterally with respect to that with which it forms a pair. But this lateral offset does not improve the paint coverage: it simply avoids accentuation of the above mentioned edge effect which would be due to the fact that, in the absence of rotation, in certain directions of movement of the machine, the strips at the edges of the band receive paint from more than two tufts.

If we now analyse the operation of the brush of FIGS. 3 and 4, it can be seen that there exist three privileged directions of movement of the machine, which are substantially those defined by the elongate pieces 22, 24 and 26 (slanted at 60° with respect to each other), for which certain strips would be painted by four tufts in the absence of rotation of the brush. It is a question of strips relatively close to the center, which would also receive four coats of paint, the strips close to the edges of the painted band only receiving one and the central strip two. Because of the more or less random rotation of the brush, each elementary painted region formed by one to four circular partially overlapping spots will have its area increased and there will finally be obtained a sufficient and sufficiently uniform coverage over the largest part of the surface of the band, whatever the direction of movement, so that the smoothing brush may smooth it completely. This is effectively the result noted.

What is claimed is:

1. An underwater painting machine comprising : a paint application brush and a smoothing brush mounted on a common frame for simultaneous translation along the submerged surface to be treated, said smoothing brush having an active end surface which continuously engages said submerged surhollow shaft.

2. The painting machine as claimed in claim 1, wherein said paint application brush is mounted for free rotation without drive means about said axis

3. The painting machine as claimed in claim 1, wherein said tufts of bristles form generally cylindrical brushes distributed uniformly in a first cylindrical ring and the bristles of the smoothing brush form a second cylindrical ring concentrically arranged about the first ring.

4. The painting machine as claimed in claim 3, wherein said means for distributing the paint comprise a hollow paint supply shaft mounted for free rotation without drive means along said axis, said shaft having inlet and outlet ends, radial paint distribution ducts fixed to the outlet end of said hollow shaft and in communication therewith, said ducts being also fixed to said first cylindrical ring and connected to an annular paint distribution chamber in communication with each of said channels at said point and means for applying said reciprocal movement of translation to said hollow shaft.

5. The painting machine as claimed in claim 4, further comprising a flange forming the base of said hollow shaft and integral with a distributor hub forming part of the assembly formed by the first ring and said radial ducts, a ball bearing formed between said flange and an annular cam centered on said shaft, said cam being rotated by a drive disk of the smoothing brush which forms said further means, said cam having a profile adapted for exerting a pulsating thrust on the balls and means for resiliently returning the hollow shaft.

6. The underwater painting machine as claimed in claim 1, wherein, in combination, the application brush is mounted freely rotating about its axis and the tufts of bristles which form it are distributed in at least two concentric rings, the tufts of the inner ring being offset angularly with respect to those of the outer ring.

7. The painting machine as claimed in claim 6, wherein the distribution of the tufts on each ring is uniform and identical in number, the offset corresponding to half of the angular distribution pitch.

8. The painting machine as claimed in claim 6, wherein the paint supply for the application brush comprises a hollow shaft having an outlet end which is connected to radial ducts, wherein said radial ducts are spaced apart at a constant angular pitch and each ends in two branch ducts aligned with each other on each side of the branching point and slanting by a constant angle and in a constant direction with respect to said radial ducts, each of these branch ducts being connected, at its end opposite this branching point, to a channel feeding a tuft of bristles, the tufts of bristles thus forming pairs each fed by a radial duct and two branch ducts, in alignment with each other and each pair being exactly superimposed on the next one by rotation of the brush about its axis.

9. The painting machine as claimed in claim 8, comprising six pairs whose branch ducts are slanted substantially through 45° with respect to the corresponding radial ducts.

* * * * *